US011325018B2

(12) United States Patent
Hösl et al.

(10) Patent No.: US 11,325,018 B2
(45) Date of Patent: May 10, 2022

(54) HEEL UNIT FOR A DOWNHILL OR A COMBINED DOWNHILL AND ALPINE TOURING SKI BINDING

(71) Applicant: TYROLIA TECHNOLOGY GMBH, Schwechat (AT)

(72) Inventors: Erwin Hösl, Hundsheim (AT); Gernot Jahnel, Katzelsdorf (AT); Christoph Wurm, Schwechat (AT)

(73) Assignee: TYROLIA TECHNOLOGY GMBH, Schwechat (AT)

( * ) Notice: Subject to any disclaimer, the term of this patent is extended or adjusted under 35 U.S.C. 154(b) by 0 days.

(21) Appl. No.: 17/090,679

(22) Filed: Nov. 5, 2020

(65) Prior Publication Data

US 2021/0236909 A1 Aug. 5, 2021

(30) Foreign Application Priority Data

Jan. 31, 2020 (AT) ..... A 50078/2020

(51) Int. Cl.
*A63C 9/08* (2012.01)
*A63C 9/084* (2012.01)

(52) U.S. Cl.
CPC ..... *A63C 9/0807* (2013.01); *A63C 9/0846* (2013.01)

(58) Field of Classification Search
CPC ..... A63C 9/0807; A63C 9/082; A63C 9/084; A63C 9/0846
See application file for complete search history.

(56) References Cited

U.S. PATENT DOCUMENTS 3,458,211 A * 7/1969 Marker ..... A63C 9/08571 280/626
4,603,880 A * 8/1986 Salomon ..... A63C 9/0844 280/628

FOREIGN PATENT DOCUMENTS

| | | | | |
|---|---|---|---|---|
| AT | 387 154 B | | 12/1988 | |
| CH | 631631 | A5 * | 8/1982 | ..... A63C 9/08 |
| DE | 202012002705 | U1 * | 6/2013 | ..... A63C 9/0807 |
| DE | 102013224574 | A1 * | 6/2015 | ..... A63C 9/0845 |
| EP | 1790245 | A1 * | 5/2007 | ..... A43B 5/0492 |
| EP | 2762211 | A2 * | 8/2014 | ..... A63C 9/0807 |
| EP | 2889064 | A1 * | 7/2015 | ..... A63C 9/0846 |

(Continued)

*Primary Examiner* — James A Shriver, II
*Assistant Examiner* — Michael T. Walsh
(74) *Attorney, Agent, or Firm* — Maschoff Brennan

(57) ABSTRACT

A heel unit for a downhill or a combined downhill and alpine touring ski binding has a vertical-release functional group with a tensioning device with a first spring assembly for holding a ski boot downhill, and a horizontal-release functional group with a base plate to be positioned on the ski and a slide that deflects laterally opposing the ski longitudinal direction against the force of a second spring assembly, on which the vertical-release functional group is arranged, as well as with a compression spring assembly acting on the horizontal-release functional group. The vertical-release functional group rotates on the horizontal-release functional group around an axis running vertically towards the top of the ski or towards the vertical, such that, after a limited lateral deflection of the slide, the vertical-release functional group rotates against the force of the second spring assembly to release of the ski boot into the respective lateral-release direction.

16 Claims, 6 Drawing Sheets

(56) References Cited

FOREIGN PATENT DOCUMENTS

| | | | | |
|---|---|---|---|---|
| EP | 3000511 A1 * | 3/2016 | ..... | A63C 9/0807 |
| EP | 2 762 211 B1 | 5/2017 | | |

* cited by examiner

HEEL UNIT FOR A DOWNHILL OR A COMBINED DOWNHILL AND ALPINE TOURING SKI BINDING

BACKGROUND

The invention relates to a heel unit for a downhill or a combined downhill and alpine touring binding for a ski, with a vertical-release functional group with a tensioning device with a sole holder and a first spring assembly for holding a ski boot in the downhill position, furthermore with a horizontal-release functional group with a base plate that can be positioned on the ski and a slide that can be deflected laterally opposing the ski longitudinal direction against the force of a second spring assembly, on which slide the vertical-release functional group is arranged.

Such a heel unit is known, for example, from EP 2 762 211 B1. This heel unit is provided for a combined downhill and alpine touring binding for a ski and comprises a vertical-release functional group, a lateral-release functional group and a locking mechanism with a locking lever, which optionally locks the heel unit either in the skiing position or in the walking position on a guide rail firmly attached to the ski. The spring assembly, which is effective in the case of a lateral release, is fixed in the ski longitudinal direction and impinges a roller that engages into the center of a recess on the slide in the downhill position. The slide is mounted on guides of the base plate in a deflectable manner exactly transversely to the ski longitudinal direction and is held in this position by the aforementioned spring assembly. In the case of a transverse release of the heel unit, the slide together with the vertical-release functional group moves transversely to the ski longitudinal direction on the base plate, wherein the spring assembly is compressed and the locking of the base plate on the guide rail is released so that the horizontal-release functional group together with the vertical-release functional group on the base plate moves backwards in the ski longitudinal direction, thereby releasing the ski boot inserted into the ski binding in this way. If a high level of force in relation to the release force, which is usually independent of the set release force, acts on the fixed ski boot, a clamping-up of the ski boot can occur and a release of the ski boot may be hindered or obstructed. Furthermore, in the case of a lateral release, the locking mechanism is actuated and the locking lever is released from its locking on the guide rail firmly attached to the ski, a relocking of the base plate is required following a lateral release by hand.

SUMMARY

Heel units with the possibility of a lateral release and a vertical release, particularly in combination, are particularly favorable for reducing the potential risk of the occurrence of serious knee injuries, such as ligament tears or ligament strains when twisting and falling backwards for example. The release characteristics of the heel unit with a lateral release and with combined horizontal and vertical releases should help to avoid such injuries, which can occur in case of the skier falling backwards, to a great extent. The heel unit should furthermore ensure a comfortable actuation when entering and getting out of it, as well as following a release, in particular, a cumbersome handling of the heel unit to restore the entry position should not be necessary in order to ensure the most comfortable entry into the ski binding, particularly following falls in deeper snow or steeper terrain.

An object of the invention is to provide a heel unit, the release characteristics of which are designed in such a way that they reduce the risk of occurrence of knee injuries more than up to this point without the risk of the ski boot becoming clamped-up in the binding.

The set task is achieved according to the invention by the vertical-release functional group being rotatable around an axis on the horizontal-release functional group, which runs vertically towards the top side of the ski or towards the vertical onto the top side of the ski at an angle of up to 5°, in such a way that, after a limited lateral deflection of the slide against the force of the second spring assembly, the vertical-release functional group rotates to a limited extent to release the ski boot into the respective lateral-release direction.

The heel unit according to the invention is therefore able to ensure a safe and particularly "ergonomic" release of the ski boot inserted into the binding in the case of a lateral release or a combined lateral and vertical release, because the movement of the ski boot during a lateral release takes place in the direction of the acting forces practically in an optimal manner This is achieved, in particular, by a lateral release taking place in two "phases". In the first phase, a "skiing phase", the slide is deflected laterally against the force of the second spring assembly; impacts are absorbed and a reset of the heel unit is made if the lateral deflection remains limited in such a way that the ski boot is not yet released. The second phase follows when a certain level of lateral deflection, i.e. the first phase, has been exceeded. In the second phase, a rotary movement of the vertical-release functional group with respect to the deflected slide of the horizontal-release functional group and a largely unhindered and safe release of the ski boot from the binding take place.

In a preferred embodiment, the vertical-release functional group can be rotated against the effect of the second spring assembly or against the effect of a further spring assembly. This measure opens up the reasonable possibility of an "automatic" reset of the horizontal-release functional group together with the vertical-release functional group after the release of the ski boot as a result of a lateral or a combined lateral and vertical release.

In a further preferred embodiment, the vertical-release functional group comprises a bearing part rotatably mounted on the slide of the horizontal-release functional group, at which the tensioning device of the vertical-release functional group is swivel-mounted around a transverse running axis. As a result, a particularly compact and functional operative connection of the vertical-release functional group to the horizontal-release functional group exists.

Preferably, the horizontal-release functional group furthermore comprises a slide guide, which interacts with control elements of the bearing part in such a way that the vertical-release functional group for releasing the ski boot in the respective release direction can be rotated to a limited extent. By means of this embodiment, the rotary movement of the vertical-release functional group relative to the horizontal-release functional group can be controlled in a simple and functionally reliable manner and can be limited in a desirable manner Another measure supporting a compact and functional embodiment of the heel unit is that the bearing part comprises a rotary part, which is rotatably arranged on the slide, wherein the axis, which runs vertically towards the top side of the ski or towards the vertical onto the top side of the ski at the angle of up to 5°, runs through the rotary part.

High levels of force often act on the heel unit, which requires a stable design of certain components, wherein, also and in particular, the bearing part is burdened. In accordance with a correspondingly favorable embodiment, the rotary part comprises two parts, in particular, circular disk-shaped ones that are firmly connected to each other running through an opening in the slide, wherein the one part is rotatably mounted to a circular or partially circular running guide notch at the top side of the slide and the other part is rotatably mounted on such a guide notch on the underside of the slide.

In the cases of a preferred optional embodiment, between the rotary part and the slide, a return spring acts, which provides support for resetting the vertical-release functional group with relation to the to the horizontal-release functional group and which is preferably a helical compression spring inserted in the region of the guide notch of the slide, the ends of which are supported in the initial position of the heel unit on the rotary part and on the slide respectively.

Another particularly favorable embodiment is characterized in that the slide along with the vertical-release functional group on the base plate can be deflected laterally along at least one circular arc-shaped path, wherein the center point of each circular arc-shaped path is in the region of a toe unit of the ski binding.

As has already been mentioned, a lateral deflection of the slide is preferably applied against the force of the second spring assembly. The operative connection between the slide and the second spring assembly now takes place in a particularly compact and functionally reliable way by the second spring assembly of the horizontal-release functional group being inserted into the base plate and being supported with its ends on spring abutments, which are each grasped on the outside by a carrier provided on the slide in such a way that, in the case of a lateral deflection of the slide, the one carrier carries the one spring abutment along with it, thereby compressing the second spring arrangement, and the second spring abutment remains supported on the base part.

Favorably, the one spring abutment for adjusting the preload of the second spring assembly is arranged in an adjustable manner with respect to the base plate by means of an adjustment screw.

The slide guide is designed in a special way with sections or sectional parts in order to be able to perform the first phase "lateral deflection" and the second phase "rotation", which effectuates a release, in a desirable manner via the control elements of the rotary part of the bearing part. Preferably, the slide guide respectively comprises a base section as outer first sections, which base sections run along a common circular arc-shaped path, wherein the center point of the circular arc-shaped path lies in the region of a toe unit of the ski binding and which base sections abut the control elements of the bearing part of the vertical-release functional group abut in the downhill position of the heel unit. As long as the control elements move along the base sections in the case of a laterally acting force, a rotary movement of the bearing part and thus the vertical-release functional group are therefore not yet possible.

The "rotation" phase is preferably made possible by further sections of the slide guide, namely by release sections each running at an angle to the transversal direction and adjoining the base sections, in such a way that the control element of the vertical-release functional group entering into one of the release sections, depending on the direction of the lateral deflection, releases this functional group to carry out a rotary movement into the respective lateral-release direction.

This rotary movement, as mentioned, is limited; a particularly expedient and favorable measure provides that a stop element respectively adjoins the release sections towards the inside in the direction towards the central longitudinal axis of the heel unit, which stop section prevents the rotation from continuing via the control element prevented from moving further, wherein, under the effect of the second spring assembly or the further additional spring assembly, the horizontal-release functional group is reset into the downhill position following a lateral release.

Thereby, the slide guide is preferably formed on a control cam member located at the top side of the base plate, thereby being firmly connected to the base plate or being designed to be a single piece with the base plate. This measure also supports a compact design of heel unit.

Preferably, the second spring assembly is designed together with the slide guide and the control elements in such a way that, for the ratio C of the torques around the tibia axis in the case of the set reference measurement Ref 1.1 according to ASTM F504 and Ref 1.5, the following applies:

$$C = \frac{\text{Ref 1.1}}{\text{Ref 1.5}}$$

wherein, for C, depending on the DIN Z number set in accordance with ISO 9462, the following applies: $0.8 \leq C \leq 1.5$.

The invention furthermore relates to a safety ski binding with a toe unit with a heel unit according to one or a plurality of the claims 1 to 14, which ski binding is a ski binding designed as a downhill binding or a as a combined downhill and alpine touring binding.

BRIEF DESCRIPTION OF DRAWINGS

Further features, advantages and details of the invention will now be described in more detail on the basis of the drawing, which shows an exemplary embodiment of a heel unit of a safety ski binding. The figures show.

DETAILED DESCRIPTION

Figure 1:
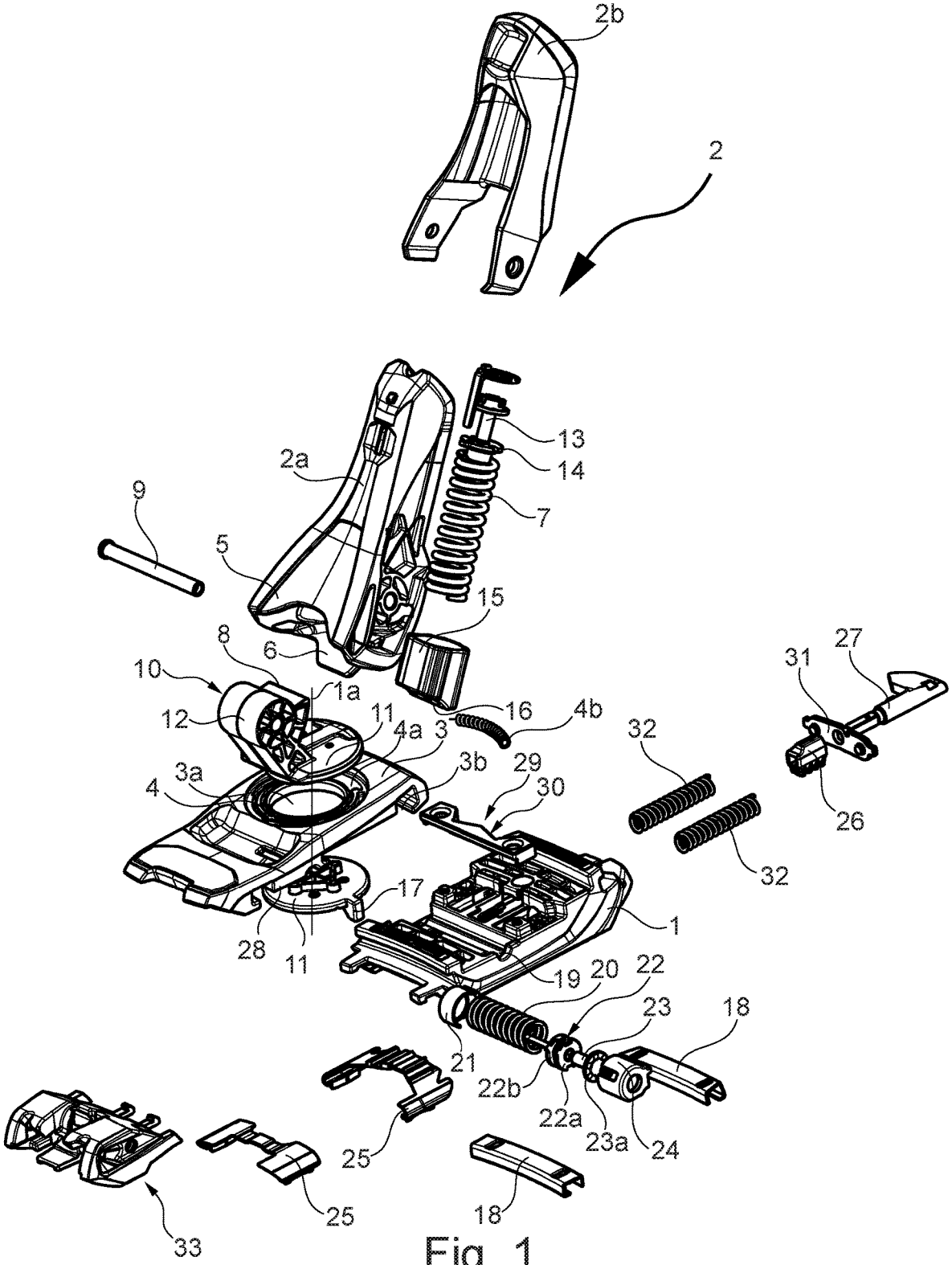
FIG. 1 an exploded illustration of an embodiment of a heel unit according to the invention, FIG. 2 a lateral view of the heel unit in the downhill position, FIG. 3 a top view of the heel unit in the downhill position, FIG. 4 a longitudinal section through the heel unit along the sectional plane indicated by line IV-IV in FIG. 3, FIG. 5 a sectional illustration in accordance with the sectional plane indicated by line V-V in FIG. 2, FIG. 6 a sectional illustration in accordance with the sectional plane indicated by line VI-VI in FIG. 2, FIG. 7 a view of the top side of a base plate and of components of a longitudinal-adjustment system, FIG. 8 a view of the underside of the base plate, FIG. 9 a view of the underside of a slide with further components of the heel unit, FIG. 10 a longitudinal section through the heel unit analogous to FIG. 4 after a vertical release, FIG. 11 a diagonal view of the heel unit in a position during a lateral release in accordance with arrow $P_2$.
Figure 2:
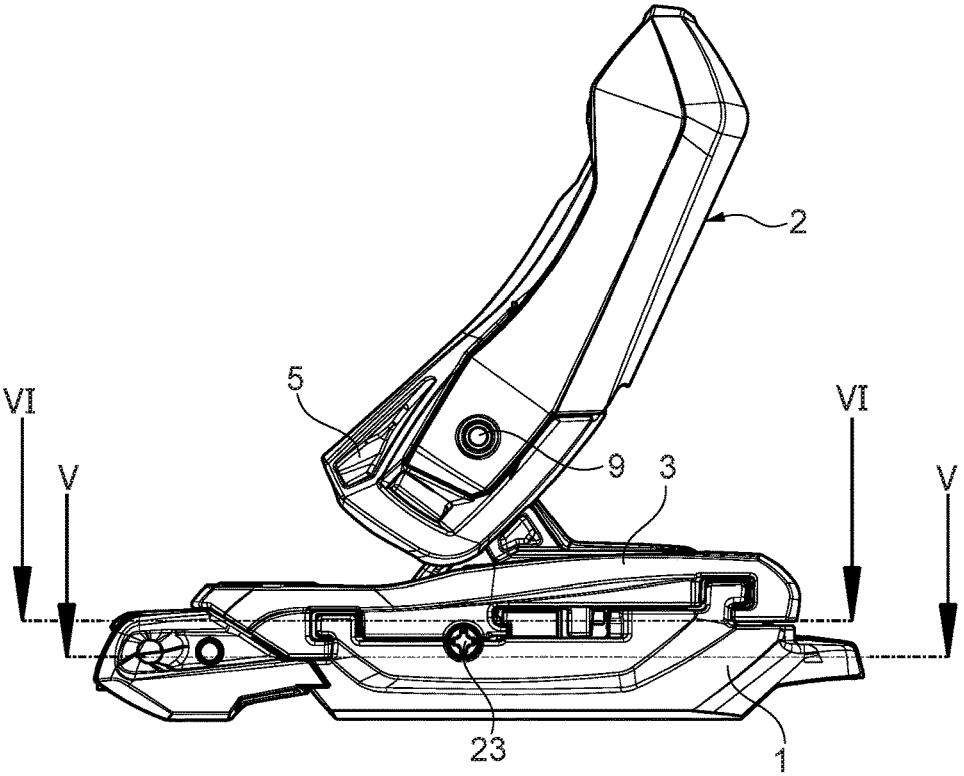
Figure 4:
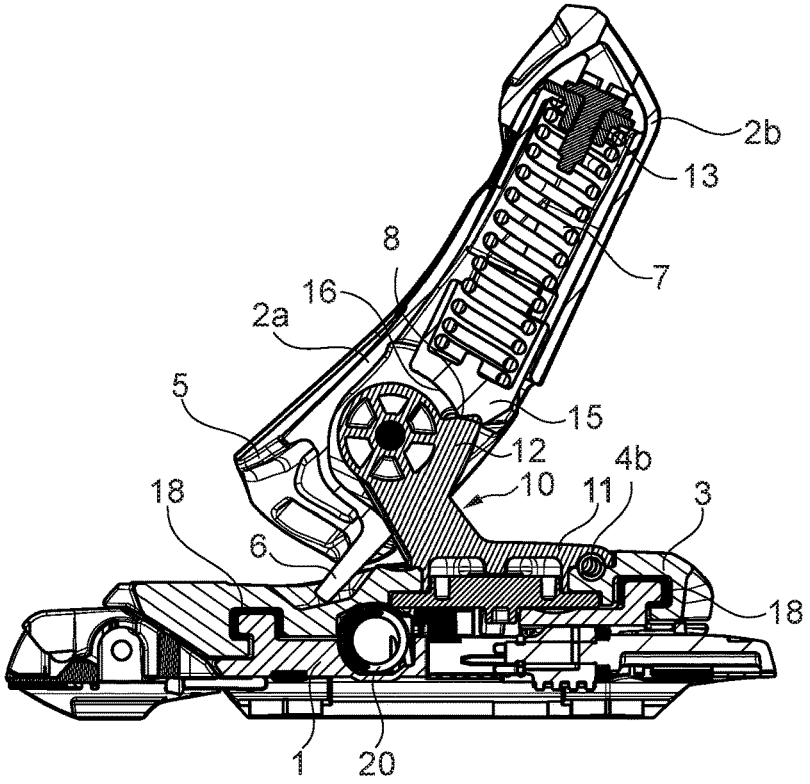
Figure 3:
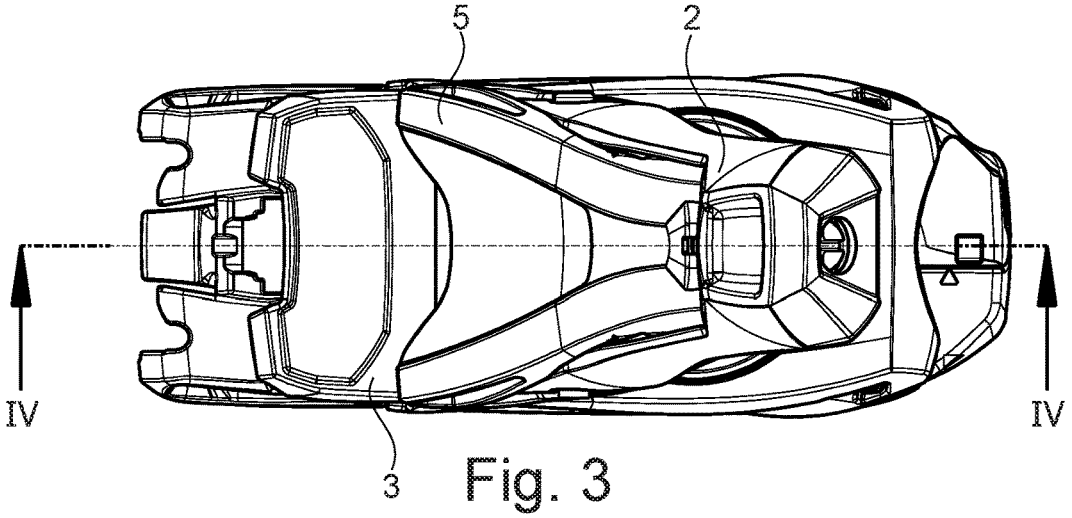
Figure 5:
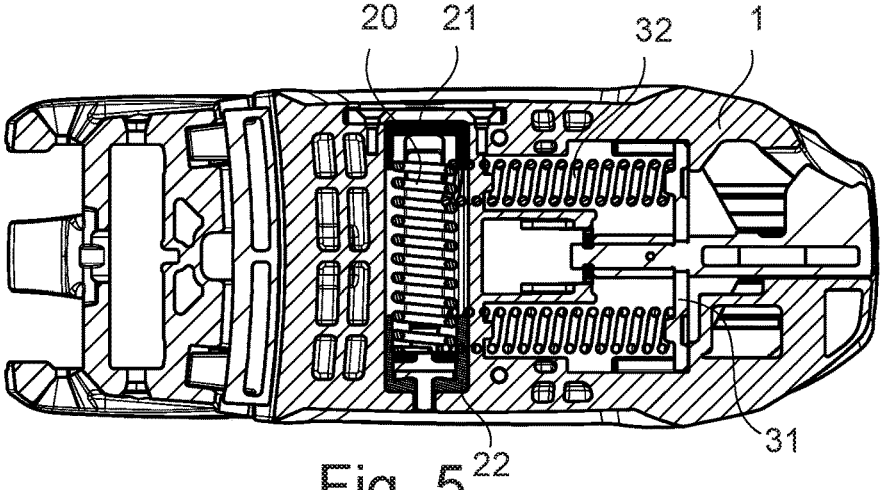

The heel unit according to the invention is an integral part of a safety ski binding with a second front retaining element, a toe unit, and holds a ski boot inserted into the safety ski binding together with this. The safety ski binding can be a ski binding designed as a downhill binding or as a combined downhill and alpine touring binding.

In the description and in the patent claims, reference is made to a heel unit mounted on the ski in order to explain the position of components. Terms such as "top side" or "underside" of components, "forwards" or "backwards", "upper" or "lower" refer to the orientation of the components concerned with respect to the ski or the top of the ski, the ski longitudinal direction, the transverse direction or the ski tip or the end of the ski. By transversal direction, a direction at a right angle to the ski longitudinal direction is understood; by lateral direction, the transversal direction or a slightly deviating direction from this, for example, as a result of a circular arc shape. For the sake of clarity, an illustration of a ski was dispensed with.

For the time being, the main components of the heel unit and their mutual arrangement will be explained in more detail on the basis of FIG. 1 to FIG. 9. The heel unit has a plurality of functional groups, to which a number of components respectively belong, wherein three of these functional groups are described in more detail below, namely a vertical-release functional group, a horizontal-release functional group and a longitudinal-adjustment functional group. The vertical-release functional group is operatively connected to the horizontal-release functional group, as is still to be described.

The vertical-release functional group comprises a tensioning device with a two-part housing 2 with a first housing part 2*a* and a second housing part 2*b*. The first housing part 2*a* is provided with a sole holder 5 and a tread spur 6 and is, in particular, designed as a single piece with these two parts. The second housing part 2*b* acts in a reinforcing manner, comprises a ski pole recess, and accommodates a first spring assembly 7—one or two helical compression spring(s)—together with the first housing part 2*a*, and is set or slid onto the first housing part 2*a* from above and connected to this via a bolt 9 and snap elements, which penetrate a bearing part 10 protruding into the interior of the housing 2. The bearing part 10 consists of a rotary part 11 which is preferably oriented parallel to the top side of the ski and a control part 12 protruding upwards from this into the interior of the housing 2. The rotary part 11 comprises two control elements 17 protruding downwards in the direction towards the top side of the ski located on its underside at the edge and located diametrically opposite to one another, the function of which is still to be described below.

The one end of the spring assembly 7 supports in the interior of the housing part 2*a* on a spring abutment 14 that can be adjusted with respect to the housing part 2*a* by means of an adjustment screw 13 so that the preload of the spring assembly 7 can be adjusted in a known manner The second end of the spring assembly 7 impinges a piston valve 15, which is sleeve-shaped so that the spring assembly 7 protrudes into the interior of the piston valve 15. The piston valve 15 is mounted in the housing 2 in a longitudinally movable manner and is supported on a control nib 8 formed on the external side of a control part 12 of the bearing part 10. The housing 2 can therefore be pivoted via the bolt 9 towards the bearing part 10 against the force of the spring assembly 7, wherein the control nib 8 slides along a control cam 16 of the piston valve 15 under compression of the spring assembly 7. The control cam 16 is designed in such a way that, both in the case of a vertical release and in the case of the arbitrary opening of the heel unit to get out of the binding, a complete pivoting of the housing 2 into the open position always takes place. The components of the vertical-release functional group are therefore responsible for a vertical release of the heel unit, as well as an arbitrary opening of the heel unit for getting out of the heel unit and for entry into the heel unit.

Figure 10:
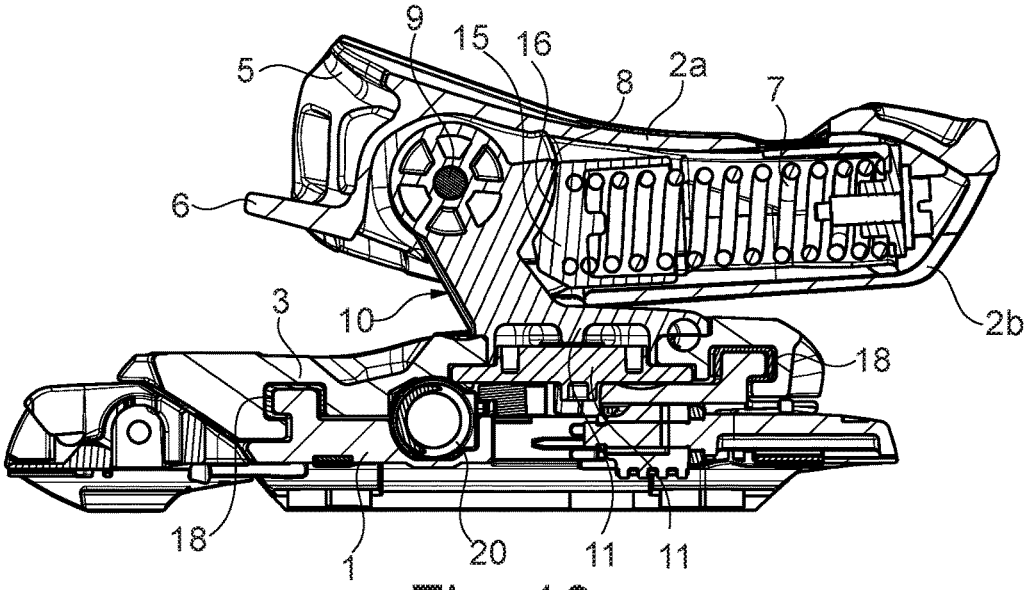

The completely open position of the heel unit after a vertical release or an arbitrary opening of the heel unit by pressing down the housing 2 is shown in FIG. 10.

Figure 8:
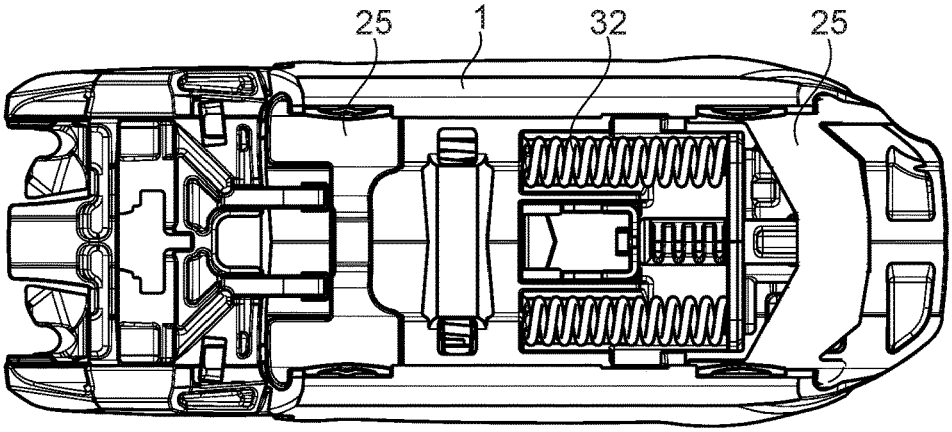

The horizontal-release functional group comprises a slide 3 and a base plate 1 as main components. The base plate 1 is located on a rail or binding plate (not shown) firmly attached to the ski; its position is adjustable in the ski longitudinal direction by means of the longitudinal-adjustment functional group. On the underside of the base plate 1, guide elements 25 shown in FIG. 1 and FIG. 8 are used, which ensure a largely low-friction guidance of the base plate 1 on the guide rail (not shown) firmly attached to the ski.

The slide 3 is a largely plate-shaped component and is mounted on the base plate 1 parallel to the top side of the ski, as is still to be described. The operative connection of the vertical-release functional group with the horizontal-release functional group takes place via the slide 3, which comprises a circular opening 3*a* (FIG. 1). The rotary part 11 consists of two circular disk-shaped parts firmly connected to one another running through the opening 3*a* in the slide 3, wherein the one part is rotatably mounted on a guide notch 4 (FIG. 1) running around the opening 3*a* on the top side of the slide 3 in a circular manner; the other part is rotatably mounted on a guide notch 4 (FIG. 9) running around in a circular manner on the underside of the slide 3. In this way, the bearing part 10 and therefore, the vertical-release functional group can be rotated with relation to the slide 3 around an axis 1a running through the center point of the rotary part 11 and vertically towards the top side of the ski. The extent of the rotary movement is, as is still to be described, limited by the control elements 17, which protrude downwards through the opening 3*a* into the region of the base plate 1. The connection of the two parts of the rotary part 11 is made in a force-locking, positive-locking, firmly bonded or frictionally engaged manner.

In an optional embodiment shown in FIG. 1, the guide notch 4 comprises a receptacle 4*a* for a return spring 4*b* (FIG. 1, FIG. 4), which, in the exemplary embodiment shown, is a helical compression spring with a low level of preload, the ends of which are supported in the initial position of the heel unit (FIG. 1) respectively, in particular, half on the rotary part 11 and half on the slide on the frame 3, here in the region of the guide notch 4. The return spring 4*b* can also be another spring, such as a leg spring, which provides support for a resetting the vertical-release functional group after its deflection by means of a corresponding assembly analogous to the helical compression spring.

In particular, a second spring assembly 20, sliding elements 18 for the slide 3, and a control cam member 29 are among the other components of the horizontal-release functional group. The base plate 1 comprises a recess 19 running in the transverse direction on its top side, into which the spring assembly 20 consisting of at least one spring, particularly a helical compression spring, is inserted. As is shown, in particular, in FIG. 1 in connection with FIGS. 5 and 6, the spring assembly 20 with its one end is supported on a spring abutment 21, which abuts the base plate 1 in the region of the one end of the recess 19. The second end of the spring assembly 20 is supported on an adjustable abutment structure, which comprises a screw nut 22*a* with a pointer element 22*b*, wherein these two parts form the second spring abutment 22. An adjustment screw 23, onto which the screw nut 21 is screwed, allows for a setting of the precompression of the spring assembly 20 in a known way and thus the release force in the case of a lateral release, which is to be described below. The adjustment screw 23 is provided with a circumferential collar 23*a*, which holds a sleeve 24, which lines up on the base plate 1 on the second end of the recess 19 and receives the end of the adjustment screw 23 in such a way that an adjustment of the spring preload from the outside is possible.

Figure 7:
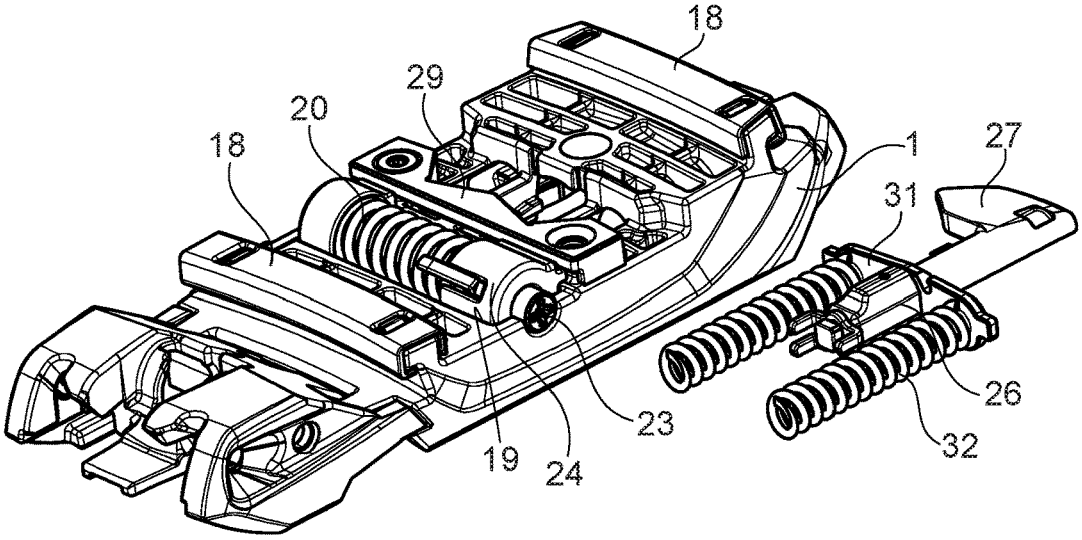
Figure 9:
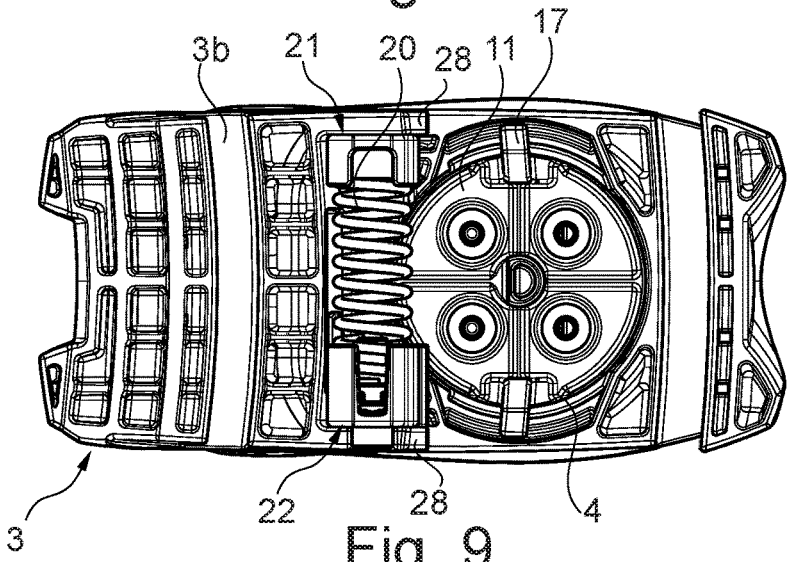

One of the sliding elements 18 running in a transversal direction over the width of the base plate 1 is attached at the front and at the rear end of the base plate 1, for example, by means of snap connections (FIG. 7). The sliding elements 18 are bent into a circular arc shape in a mirrored-symmetrical manner to the central longitudinal axis of the heel unit, wherein the common center point of the arcs is in the region of the toe unit (not shown) of the ski binding and the radius of the arc of the front of the two sliding elements 18 is at a magnitude of about 305 mm (Type-A base test sole in accordance with ISO 9838:2008, Section 3.5); the arc of the rear sliding element 18 is based on a circle with a radius, which is approximately greater by the mutual distance of the two sliding elements 18. The slide 3 is pushed onto the two sliding elements 18 and namely, by means of correspondingly designed sliding guides 3*b* formed on its underside, as is shown in FIG. 9. Between each sliding guide 3*b* and the associated sliding element 18, a certain play is present, wherein, between the rear sliding guide 3*b* and the associated sliding element 18, a larger play is present, wherein a clamping-up or tilting of the slide 3 is avoided in the case of a lateral movement. The slide 3 can therefore be deflected laterally along with the vertical-release functional group towards the base plate 1 along a total circular arc-shaped path. This lateral deflection of the slide 3 is only possible against the force of the spring assembly 20, i.e. compressing it, as is still to be described in detail.

As is shown in FIG. 9 for example, the slide 3 comprises one carrier 28 on its underside between its sliding guides 3*b* towards the rear of the opening 3*a* on each of its lateral longitudinal sides. The one carrier 28 contacts the spring abutment 21 of the spring assembly 20 from the outside, the second carrier 28 contacts the sleeve 24 of the adjustable abutment structure from the outside.

The previously mentioned control cam member 29 (FIGS. 1, 6 and 7) is an oblong component, which is inserted in a transversal direction running at the top side of the base plate 1 towards the rear of the recess 19 and the spring assembly 20 and is firmly fixed into position. In an alternative embodiment, the control cam member 29 is designed as a single piece with the base plate. The control cam member 29 has a slide guide 30 along its rear edge. In accordance with FIG. 6 and FIG. 12, the slide guide 30 is designed to be mirror-symmetrical with respect to the central longitudinal axis of the heel unit and, in a top view, comprises two V-shaped slide guide sectional parts 30*a* in the exemplary embodiment shown, which adjoin each other in the middle at the aforementioned longitudinal axis n, wherein the V-tips point forwards.

Figure 6:
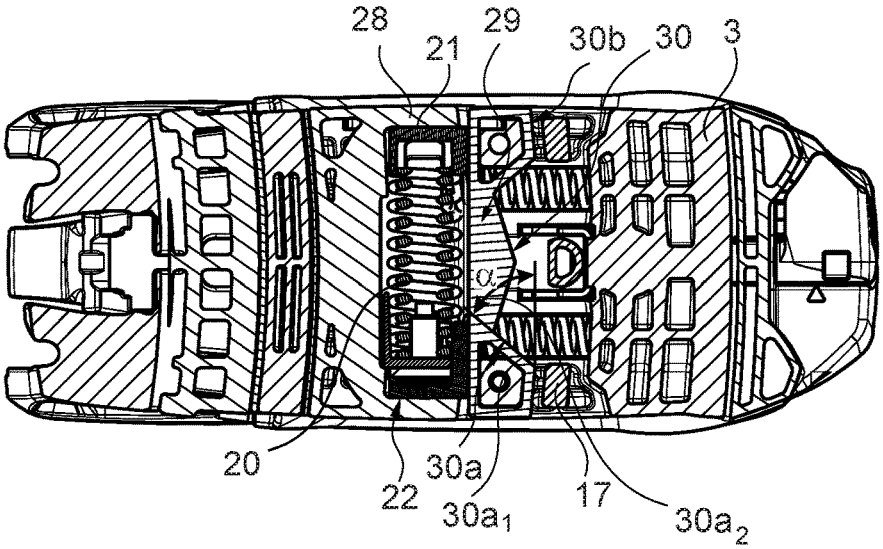

Each slide guide sectional part 30*a* therefore consists, viewed from the outside to the inward towards the longitudinal axis, of a release section $\mathbf{30}a_1$ running at an acute angle $\alpha$ from 35° to 70° towards the transversal direction and a second inner stop section $\mathbf{30}a_2$ running at a blunt angle $\beta$ (FIG. 12) of about 95° to 130° to this. Base sections 30*b* running in the direction of the lateral edge regions of the base plate 1 adjoin the release sections $\mathbf{30}a_1$, which base sections 30*b* run along a circular arc-shaped path, wherein the center point of the circle of this circular arc-shaped path corresponds to the center point of the circles of the circular shape of the sliding elements 18 (FIG. 7) The control elements 17 of the bearing part 10 of the vertical-release functional group are located on the base sections 30*b*, in the downhill position of the heel unit, as shown in FIG. 6 for example.

An exemplary embodiment of the mentioned longitudinal-adjustment functional group is shown by FIG. 1 and FIG. 8 in particular. This functional group comprises a bar 26 with a toothing, which bar 26 is axially or radially connected to a lever 27 in a force-locking, positive-locking, firmly bonded, or frictionally engaged manner, which projects over the heel unit on the back side, and can be engaged or disengaged with a toothing on a guide rail (not shown) in a known way. Two compression springs 32 that are parallel to one another and oriented in the ski longitudinal direction are supported on a support 31 provided on the lever 27, which compression springs 32 are accordingly supported with their second ends on the underside of the base plate 1.

Figure 11:
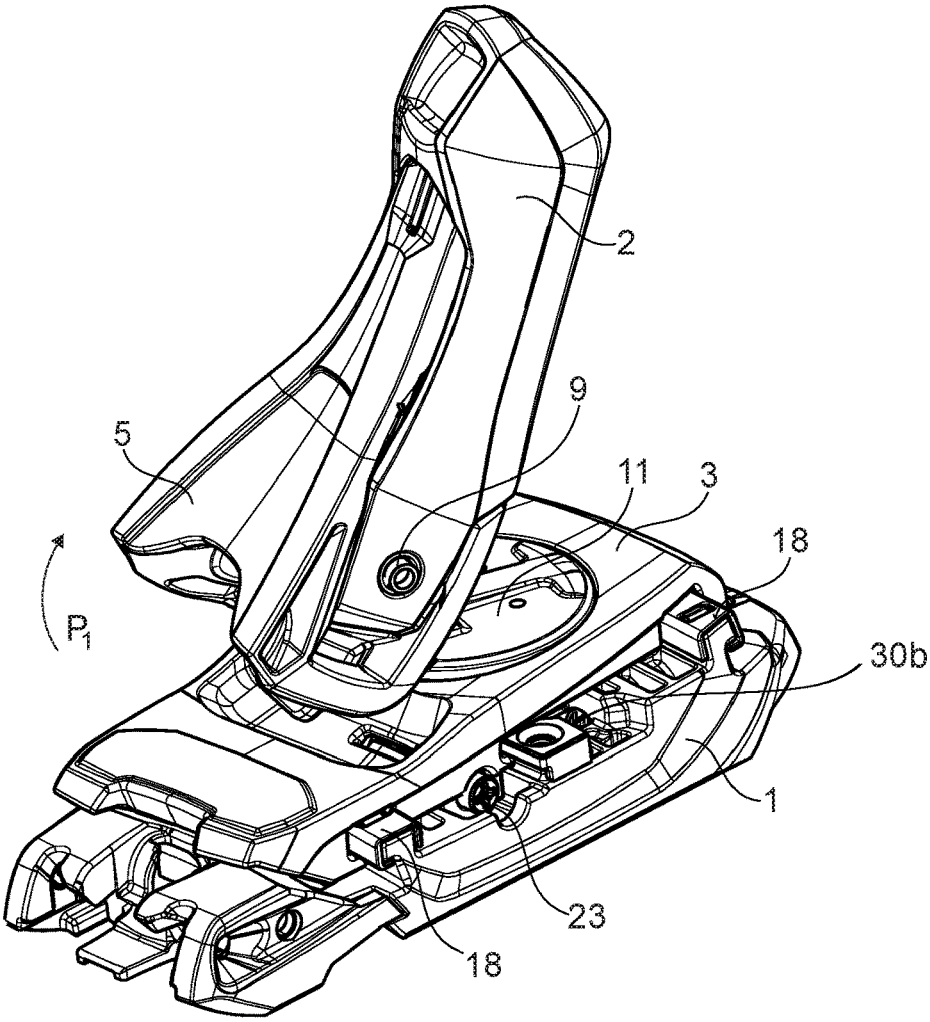
Figure 12:
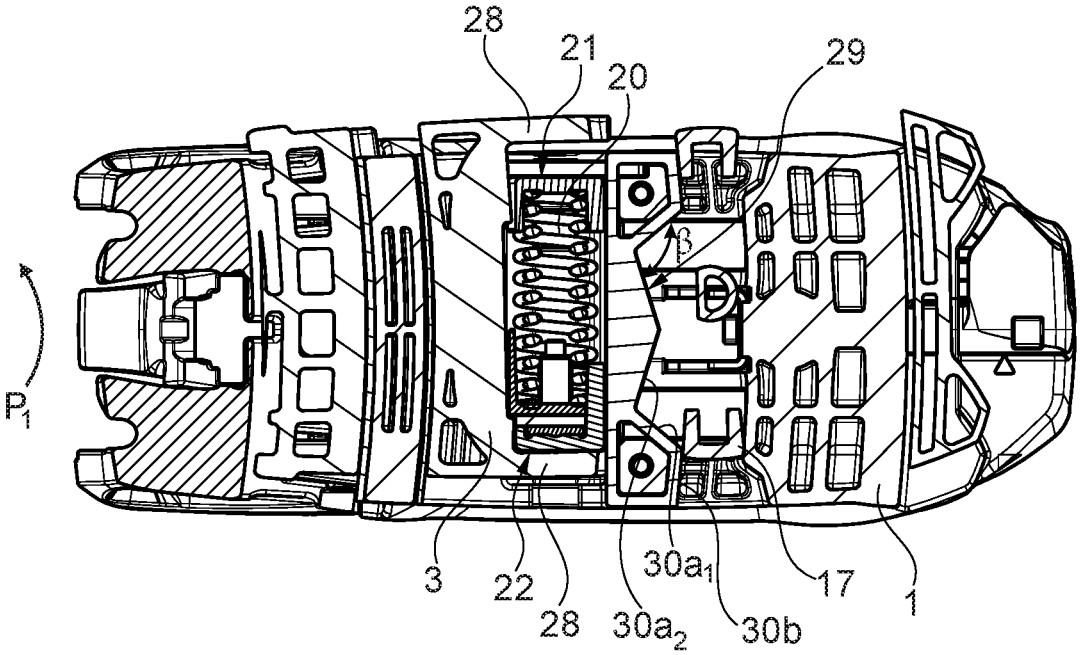
FIG. 12 and FIG. 13 show two consecutive stages during lateral release in sectional illustrations analogous to FIG. 5 and FIG. 6.

The heel unit furthermore comprises a brake-device functional group, which has not been shown in detail, with a ski brake (not shown), which has been designed in a well-known way. For example, in FIG. 1, from this functional group, only a ski brake housing 33 is shown, which is connected to the base plate 1 and is also designed to be a single piece with this where applicable. The connection of the ski brake housing 33 to the base plate 1 can be established via snap connections in a force-locking or frictionally engaged manner A release of the heel unit under release of the ski boot by forces acting in a lateral direction or by forces acting in a lateral and the vertical direction, is now described in more detail below on the basis of FIGS. 11 to 13. The initial position, which also corresponds to the downhill position, is shown, for example, in FIGS. 2, 3, 5 and 6. The essential movement sequences of the components involved in a lateral release can best be determined and explained by means of the sectional illustrations in FIGS. 12 and 13. A first phase of lateral release is shown in FIG. 12. In the case of correspondingly great forces acting from the ski boot inserted in the direction symbolized by arrow $P_1$ in FIG. 12 onto the sole holder 5 of the vertical-release functional group, the slide 3 is deflected laterally, wherein, via the lower carriers 28 of the slide 3 in FIG. 12, the spring assembly 20 is compressed. The vertical-release functional group arranged on the slide 3 is moved along with the slide 3. In this case, the control elements 17 of the rotary part 11 initially slide along the base sections 30*b* of the slide guide 30 according to the lateral-release direction.

Figure 13:
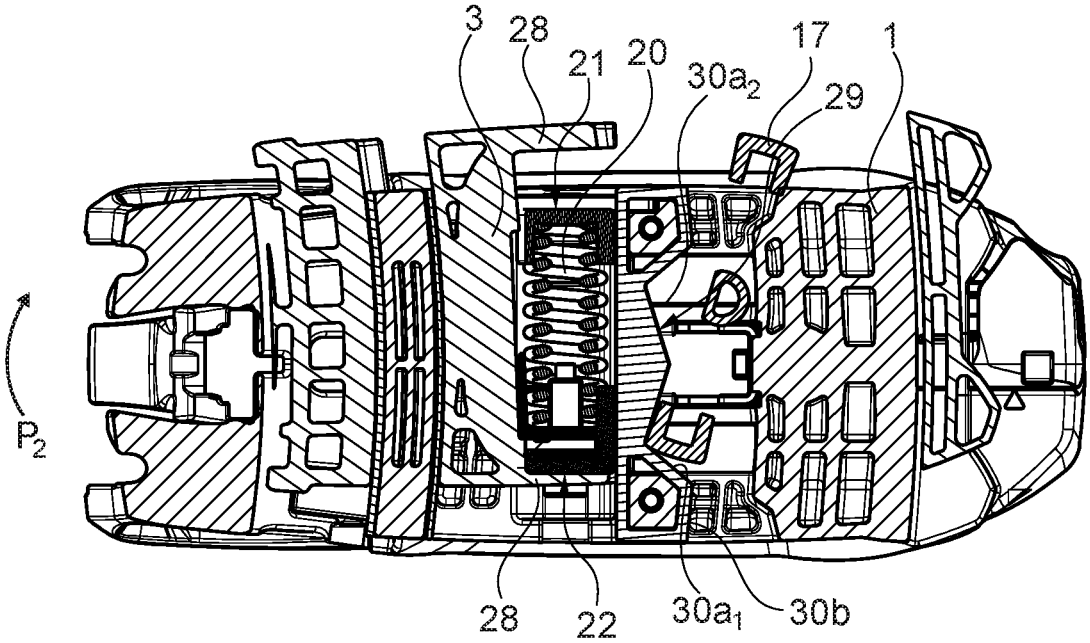

FIG. 13 shows each stage of a lateral release, in which the spring assembly 20 is further compressed by the continued swiveling out of the slide 3 along the sliding element 18 of the base plate 1, and the lower control element 17 in FIG. 13 has passed the edge between the base section 30*b* and, in the adjoining slide guide sectional part 30*a*, has reached its V-tip and is stopped here. Upon exceeding of the mentioned edge, the rotary part 11 is released for a rotary movement in the direction of the arrow $P_2$ in FIG. 13 together with the vertical-release functional group; the ski boot is released. The spring assembly 20 is further compressed a bit until reaching the stop position—the relevant control element 17 of the bearing part 10 stops at stop section $\mathbf{30}a_2$, and prevents a continuation of the rotary movement of the vertical-release functional group. The comparatively weak return spring 4*a* is also compressed or preloaded more during the rotary movement of the rotary part 11. The components of the heel unit involved in this movement sequence are designed or matched to each other accordingly. FIG. 13 therefore shows the final position of a lateral release. After the release of the ski boot, the slide 3 and therefore the horizontal-release functional group together with the vertical-release functional group under the effect of the spring assembly 20 are reset into the initial position. The return spring 4*a* provides support for resetting of the vertical-release functional group with relation to the horizontal-release functional group.

Of course, a lateral release can be combined with a vertical release, depending on the torques and forces exerted by the ski boot onto the heel unit. In the case of a vertical release, the heel unit or the vertical-release functional group is moved into the downhill position when the ski boot is re-inserted.

The invention is not limited to the embodiment of the heel unit that is described and shown. For example, the control elements on the rotary part can be provided with rotatable rollers or consist of rotatable rollers. Furthermore, the vertical-release functional group can be rotatable against the force of another spring assembly and preferably be resettable with effect of this spring assembly.

REFERENCE NUMBER LIST

1 base plate
1*a*. . . vertical axis
2 . . . housing
2*a*, 2*b*. . . housing part
3 . . . slide
3*a*. . . opening
3*b*. . . sliding guide
4 . . . guide notch
4*a*. . . receptacle
4*b*. . . return spring
5 . . . sole holder
6 . . . tread spur
7 . . . spring assembly
8 . . . control nib
9 . . . bolt
10 . . . bearing part
11 . . . rotary part
12 . . . control part
13 . . . adjustment screw
14 . . . spring abutment
15 . . . piston valve
16 . . . control cam
17 . . . control element
18 . . . sliding element
19 . . . recess
20 . . . spring assembly
21 . . . spring abutment
22 . . . spring abutment
22*a*. . . screw nut
22*b*. . . pointer element
23 . . . adjustment screw
23*a*. . . collar
24 . . . sleeve
25 . . . guide element
26 . . . bar
27 . . . lever
28 . . . carrier
29 . . . control cam member
30 . . . slide guide
30*a*. . . slide guide sectional part
30$a_1$. . . release section
30$a_2$. . . stop section
30*b*. . . base section
31 . . . support
32 . . . compression spring
33 . . . ski brake housing
α, β. . . angles
$P_1$, $P_2$. . . arrow

The invention claimed is:

1. A heel unit for a downhill or a combined downhill and alpine touring binding for a ski, comprising:

a vertical-release functional group with a tensioning device with a sole holder and a first spring assembly for holding a ski boot in the downhill position, and a horizontal-release functional group with a base plate that can be positioned on the ski and a slide that can be deflected laterally opposing the ski longitudinal direction against the force of a second spring assembly, on which the vertical-release functional group is arranged, and a compression spring assembly acting on the horizontal-release functional group, wherein:

the vertical-release functional group can be rotated on the horizontal-release functional group around an axis, which runs vertically from the top side of the ski or at an angle of up to 5° from a vertical axis, in such a way that, after a limited lateral deflection of the slide against the force of the second spring assembly, the vertical-release functional group rotates to release the ski boot into the respective lateral-release direction.

2. The heel unit according to claim 1, wherein the vertical-release functional group can be rotated against the force of the second spring assembly or another spring assembly and can preferably be reset with effect of this spring assembly.

3. The heel unit according to claim 1, wherein the vertical-release functional group comprises a bearing part rotatably mounted on the slide of the horizontal-release functional group, on which the tensioning device of the vertical-release functional group is swivel-mounted around a transversally running axis.

4. The heel unit according to claim 1, wherein the horizontal-release functional group comprises a slide guide, which interacts with control elements of a bearing part rotatably mounted on the slide of the horizontal-release functional group and in such a way that the vertical-release functional group can be rotated to a limited extent to release the ski boot into the respective lateral-release direction.

5. The heel unit according to claim 3, wherein:

the bearing part comprises a rotary part, which is arranged in a rotatable manner on the slide, and the axis, which runs vertically from the top side of the ski or at an angle of up to 5° from a vertical axis, runs through the rotary part.

6. The heel unit according to claim 5, wherein:

the rotary part consists of two parts, in particular circular, disk-shaped ones, that are firmly connected to each other running through an opening in the slide, and one part is rotatably mounted to a circular or partially circular running guide notch at the top side of the slide and the other part is rotatably mounted on such a guide notch on the underside of the slide.

7. The heel unit according to claim 1, wherein, between the rotary part and the slide, a return spring acts, which provides support for resetting the vertical-release functional group with relation to the horizontal-release functional group and which is preferably a helical compression spring inserted in the region of the guide notch of the slide, the ends of which are supported in the initial position of the heel unit on the rotary part and on the slide respectively.

8. The heel unit according to claim 1, wherein:

the slide together with the vertical-release functional group on the base plate can be deflected laterally along at least one circular arc-shaped path, and the center point of each circular path lies in the region of a toe unit of the ski binding.

9. The heel unit according to claim 1, wherein the second spring assembly of the horizontal-release functional group is inserted in a transversal direction running into the base plate and supported with its ends on spring abutments, which are each grasped on the outside by a carrier provided on the slide in such a way that, in the case of a lateral deflection of the slide, the one carrier carries the one spring abutment, thereby compressing the second spring arrangement, and the second spring abutment remains supported on the base part.

10. The heel unit according to claim 9, wherein the one spring abutment for adjusting the preload of the second spring assembly is arranged in an adjustable manner with respect to the base plate by means of an adjustment screw.

11. The heel unit according to claim 4, wherein:

the slide guide respectively comprises a base section as outer first sections, which base sections run along a common circular arc-shaped path, and the center point of the circular path is in the region of a toe unit of the ski binding and which base sections abut the control elements of the bearing part of the vertical-release functional group in the downhill position of the heel unit.

12. The heel unit according to claim 4, wherein the slide guide respectively comprises release sections adjoining the base sections each running at an angle to the transversal direction in such a way that a control element of the vertical-release functional group entering into one of the release sections releases this functional group to carry out a rotary movement into the respective lateral-release direction.

13. The heel unit according to claim 12, wherein a stop section respectively adjoins the release sections towards the inside in the direction towards the central longitudinal axis in such a way that the rotary movement of the vertical-release functional group is stopped and the second spring assembly or the other additional spring assembly resets the horizontal-release functional group into the downhill position following a lateral release.

14. The heel unit according to claim 4, wherein the slide guide is formed on a control cam member located on the top side of the base plate, firmly connected to the base plate or designed to be a single piece with the base plate.

15. The heel unit according to claim 4, wherein the second spring assembly together with the slide guide and the control elements is designed in such a way that, for the ratio C of the torques around the tibia axis in the case of the set reference measurement Ref 1.1 according to ASTM F504 and Ref 1.5, the following applies:

$$C = \frac{\text{Ref 1.1}}{\text{Ref 1.5}}$$

wherein, for C, depending on the DIN Z number set in accordance with ISO 9462, the following applies: $0.8 \leq C \leq 1.5$.

16. A safety ski binding with a toe unit and with a heel unit according to claim 1, which ski binding is a ski binding designed as a downhill binding or a ski binding designed as a combined downhill and alpine touring binding.

* * * * *